United States Patent [19]

Spriggs

[11] 4,018,110

[45] Apr. 19, 1977

[54] STOPPER REMOVER

[76] Inventor: Samuel C. Spriggs, 1076 Shadow Lane, Mount Pleasant, S.C. 29464

[22] Filed: July 13, 1976

[21] Appl. No.: 704,779

[52] U.S. Cl. ..... 81/3.1 B; 81/3.46 R; 81/302; 29/268

[51] Int. Cl.[2] ..... B67B 7/02

[58] Field of Search ..... 29/239, 268; 81/3.1 B, 81/3.34, 3.36, 3.37, 3.38 R, 3.44, 3.46 R, 302

[56] References Cited

UNITED STATES PATENTS

| | | | |
|---|---|---|---|
| 58,820 | 10/1966 | Hazard | 81/3.36 |
| 2,551,511 | 5/1951 | Talbot | 81/3.46 R |
| 2,722,857 | 11/1955 | Lacey | 29/268 X |
| 3,825,990 | 7/1974 | Shields | 29/268 |

*Primary Examiner*—Al Lawrence Smith
*Assistant Examiner*—James G. Smith
*Attorney, Agent, or Firm*—Dennison, Dennison, Meserole & Pollack

[57] ABSTRACT

A hand manipulable device for removing bottle stoppers comprising upper and lower bifurcated jaws engageable about the neck of a bottle between the shoulder and mouth of the bottle for engagement of the upper jaw below the overhanging stopper head whereby a spreading of the jaws effects an upward withdrawal of the stopper. A retaining arm is fixed to the upper jaw and extends generally centrally thereover in outwardly spaced relation thereto for engagement over the head of the stopper in a manner so as to retain the stopper subsequent to release thereof from the bottle.

6 Claims, 5 Drawing Figures

STOPPER REMOVER

The present invention is generally concerned with a device for opening bottles by the removal of the normally provided plastic or cork stopper. More particularly, the invention is concerned with a device for removing stoppers from champagne bottles and the like in a manner whereby the removed stopper is securely retained within the device both during and subsequent to the removal of the stopper from the bottle.

One of the substantial hazards associated with the opening of champagne bottles in particular is the every present likelihood of someone being struck by the released stopper or cork propelled by pressure internally generated within the bottle. Such pressure propelled stoppers have been known to cause serious injuries including the loss of eyesight.

Accordingly, it is a primary object of the invention to provide means for effectively extracting a stopper from champagne bottles and the like in a manner whereby any danger of the stopper "flying" or being propelled by internal pressures is eliminated.

In conjunction with the above object, it is also a significant object of the present invention to provide a device which, through a simple hand manipulation, is capable of smoothly and efficiently uncorking a bottle with the cork, both throughout the removal operation and subsequent thereto, being positively retained.

Other objects of the invention include the provision of a device or tool which is capable of use with a variety of bottle constructions, a tool which can be easily and conveniently manipulated utilizing one hand so as to leave the second hand free to grasp the bottle, and a tool which is of simple rugged construction basically utilizing only two moving parts.

The objects of the invention are achieved through the provision of a tool which utilizes a pair of interconnected elongated levers defining grasping and manipulating handles at one end thereof and operating jaws at the second end. The jaws, constituting upper and lower jaws, each include bifurcated portions biased into engaging overlying relationship by appropriate spring means, normally provided between the handles. The bifurcated portions are received about the neck of a bottle between the shoulder thereon and the overlying enlarged stopper head. The upper jaw additionally includes an arm overlying the upper jaw bifurcated portion in outwardly spaced relation thereto so as to overlie the exposed head of the stopper and combine with the arms of the bifurcated portion to in effect define a retaining cage for the stopper. In use, after positioning the jaws about the bottle neck and stopper, the jaws are spread, through a manipulation of the handles, and the stopper smoothly extracted from the neck of the bottle with the stopper at all times being retained against accidental pressurized discharge by the overlying retaining arm.

The following patents constitute the most pertinent prior art known at this time:

| | |
|---|---|
| 50,868 | Woolaver |
| 58,820 | Hazard |
| 73,370 | Morton |
| 99,080 | Gooch |
| 1,741,607 | Bradley |

These together with additional objects and advantages will become subsequently apparent from the following description. Reference is had to the accompanying drawings forming a part hereof wherein like numerals refer to like parts throughout, and in which.

Figure 1:
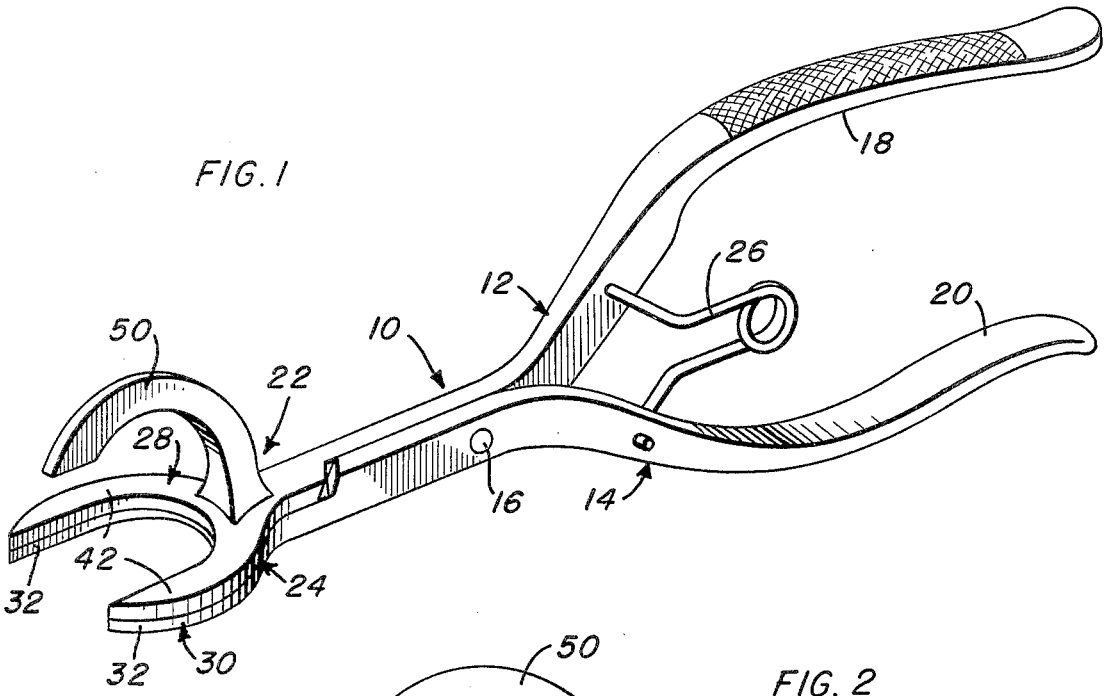
FIG. 1 is a perspective view of the stopper remover of the present invention.

Referring now more particularly to the drawings, reference numeral 10 is used to designate the device or tool comprising the present invention. The device 10 is basically of a simple hand manipulable construction including a pair of elongated rigid levers 12 and 14 pivotally interconnected at an intermediate point 16 to define opposed handles 18 and 20 toward one end thereof and opposed jaws 22 and 24 to the second end thereof.

The levers 12 and 14 are hereinafter designated as upper lever 12 and lower level 14, such being their orientation during normal usage, that is in the extraction of a stopper from a vertical or substantially vertically orientated bottle.

As will be noted, the levers 12 and 14 do not cross each other at the point of pivotal engagement so as to define a conventional scissors-type construction. Rather, the upper lever 12 defines both the upper handle 18 and the upper jaw 22 while the lower lever 14 defines the lower handle 20 and the lower jaw 24. In this manner, a movement of the handles 18 and 20 toward each other will effect a corresponding spreading of the jaws 22 and 24. The handles 18 and 20 will normally be resiliently biased apart by an appropriate spring 26 engaged therebetween. This in turn results in a resilient biasing of the jaws 22 and 24 together and normally in engagement with each other.

Each of the jaws 22 and 24 respectively include a yoke or bifurcated portion 28 and 30. The bifurcated portion 30 associated with the lower jaw 24 is defined by a pair of flat forwardly projecting curved arms 32 forming in effect a forwardly opening semi-circular configuration adapted to smoothly receive the neck 34 of a bottle 36 therewithin. The spacing and configuration of the arms 32 are such so as to seat on the normally provided outwardly projecting bead or shoulder 38 surrounding the bottle neck 34 in downwardly spaced relation to the mouth or upper end 40 of the bottle so as to react against this shoulder 38 in the use of the device as shall be explained subsequently.

The bifurcated portion 28 associated with the upper jaw 22 is a substantial duplicate of the lower bifurcated portion 30 and similarly includes a pair of flat forwardly projecting arcuate arms 42 which combine to define a forwardly opening semi-circular configuration. The upper bifurcated portion 28 is also receivable about the neck 34 of the bottle 36 with the spacing and configuration of the arms 42 being such so as to, while accommodating the neck 34, and any lip 44 provided about the mouth 40 of the bottle 36, will abut or engage against the undersurface of the enlarged head 46 of the plastic or cork stopper 48 whereby a positive extracting force can be applied thereto.

The upper jaw 22 also includes a retaining arm 50. This arm 50 has one end thereof fixed to the bight area of the bifurcated portion 28 and arches upwardly and forwardly therefrom so as to centrally overlie the upper bight portion 28 in upwardly spaced relation thereto. The free outer end of the retaining arm 50 terminates sufficiently above the free ends of the bifurcated portion arms 42 so as to allow free passage of the enlarged stopper head 46 into its nested position between the arms 42 and below the overlying retaining arm 50.

Figure 2:
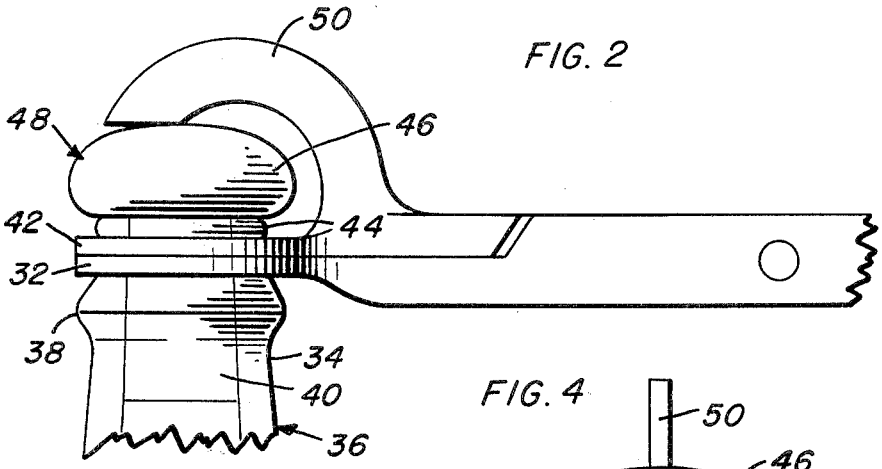
FIG. 2 is a side view of the remover engaged in operative position on a closed bottle.
Figure 5:
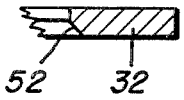
FIG. 5 is a cross-sectional detail taken substantially on a plane passing along line 5—5 in FIG. 3.
Figure 4:
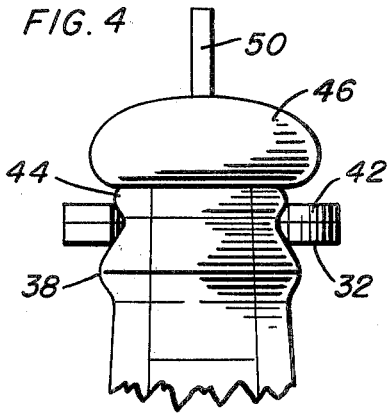
FIG. 4 is a front view of the construction of FIG. 2.
Figure 3:
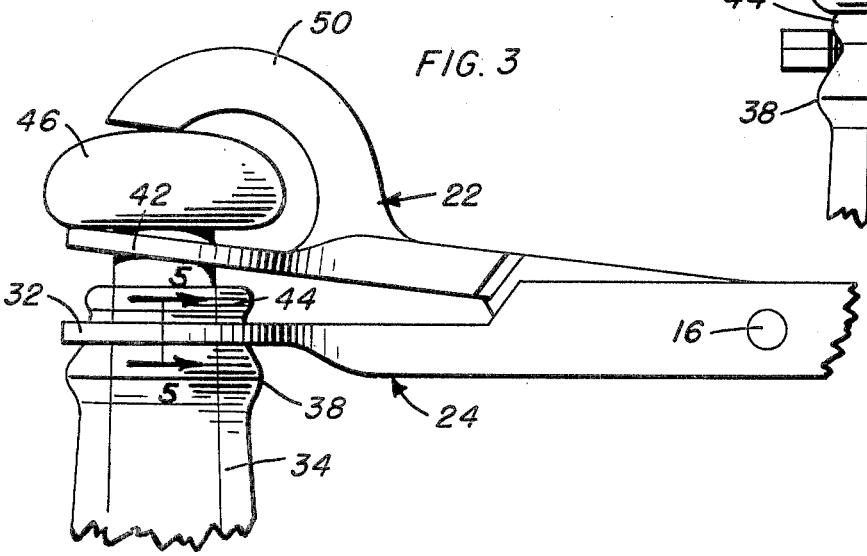
FIG. 3 is a side elevational view similar to FIG. 2 with the stopper partially extracted.

In use, the upper and lower bifurcated portions 28 and 30, as will be best appreciated from FIG. 2, are positioned about the neck 34 of the bottle 36 between the annular shoulder 38 and the overlying stopper head 46. Next, and noting FIG. 3 in particular, the handles 18 and 20, easily graspable within a single hand, are moved toward each other so as to effect a separation of the jaws and a corresponding upward extraction of the stopper 48, the bifurcated portion 30 of the lower jaw 24 reacting against the bottle shoulder 38. Incidentally, in regard to the engagement of the lower bifurcated portion 30 with the shoulder 38, as will be appreciated from the cross-sectional detail of FIG. 5, the undersurface of the lower arms 32 can be slightly beveled, as at 52, so as to more smoothly engage the shoulder 38.

As the stopper 48 is being retracted, the overlying retaining arm 50, either directly engaged with the enlarged head 46 or spaced slightly thereabove, at all times, in cooperation with the lifting arms 42, positively retains the stopper 48, resisting any tendency for the stopper 48 to freely fly from the bottle due to internal pressures within the bottle. In this manner, provision is uniquely made for both simplifying the opening of a champagne bottle and avoiding a potential source of injury or damage. Subsequent to a complete extraction of the stopper 48 from the bottle 36, the stopper 48 can be easily removed from the tool 10 and disposed of.

What is claimed is:

1. A device for removing a headed stopper from a container, said device comprising first and second jaws, handle means engaged with said jaws for a manipulation of said jaws between a first overlying closed position and a second spaced open position, said first jaw comprising force reaction means for engaging and positioning said device on a container adjacent a stopper to be removed, said second jaw including force transmitting means engageable below the head of a stopper and between the stopper head and the container for effecting an upwardly directed stopper removing force on the head of a stopper, said second jaw also including retaining means extending in outwardly spaced overlying relation to said force transmitting means and engageable over the head of a stopper for a retention thereof within the second jaw as the stopper removing force is being applied.

2. The device of claim 1 wherein said force reaction means of the first jaw comprises a first bifurcated portion having a first pair of opposed arms engageable about the neck of a bottle above a shoulder defined thereabout, said force transmitting means of said second jaw comprising a second bifurcated portion having a second pair of opposed arms engageable about the neck of a bottle above the first bifurcated portion and below the head of a stopper received within the neck of the bottle for a removal of the stopper upon relative movement of the jaws away from each other.

3. The device of claim 2 wherein said retaining means comprises a retaining arm overlying said second pair of arms generally centrally therebetween.

4. The device of claim 3 wherein said first and second pair of arms are arcuate.

5. The device of claim 3 wherein said retaining arm has a first end thereof fixed to the second bifurcated portion between the second pair of arms.

6. The device of claim 3 including spring means resiliently biasing said jaws into said first overlying closed position.

* * * * *